United States Patent [19]

Rosenfeld

[11] 4,061,910

[45] Dec. 6, 1977

[54] LUMINESCENT JEWELRY

[75] Inventor: Steven Allen Rosenfeld, New York, N.Y.

[73] Assignee: Barry G. Magidoff, New York, N.Y. ; a part interest

[21] Appl. No.: 654,506

[22] Filed: Feb. 2, 1976

[51] Int. Cl.[2] ..... F21V 9/16; A44C 13/00

[52] U.S. Cl. ..... 362/34; 63/1 R; 362/104

[58] Field of Search ..... 240/2.25, 6.4 W, 6.4 R; 63/1 R, 2; 250/462, 467; 252/188.3 CL; 46/1 R; 273/DIG. 24

[56] References Cited

U.S. PATENT DOCUMENTS

| | | | |
|---|---|---|---|
| 2,738,616 | 3/1956 | Windle | 46/1 R |
| 3,536,794 | 11/1970 | Rauhut et al. | 240/2.25 |

*Primary Examiner*—John Gonzales

*Attorney, Agent, or Firm*—Barry G. Magidoff

[57] ABSTRACT

This invention provides an article of chemiluminescent jewelry, preferably having provision for separately releasably sealed compartments containing chemiluminescent components or replacement means for replaceably providing a chemiluminescent material.

3 Claims, 7 Drawing Figures

LUMINESCENT JEWELRY

This application is directed to a new and improved article of jewelry and other decorative and ornamental devices for wearing on the person, wherein the ornamentation is at least partially provided by an internal chemiluminescence. The luminescent nature of this jewelry and ornamentation is sufficient to not only render the piece visible in a darkened area, but also to provide sufficient light to illuminate surrounding space and objects located therein, including the body and/or clothing or other jewelry and ornamentation worn by the person.

The recent development in chemistry which has enabled man to copy the firefly, to provide chemiluminescent light by the admixture of chemical components, has been previously described in U.S. Pat. No. 3,597,362, for example. The light-emitting quality of the chemiluminescent liquids, described in the above U.S. Patent, has been practically utilized in a light-emitting stick which has been marketed for use, for example, as a safety flare, as an emergency light source, and especially for use in those areas where a hot source of light, even for example, an electric light bulb, or neon tube, would present a hazard. Such hazardous uses have included, for example, highly volatile fuel areas for the military. The device which has made use of the chemiluminescent nature of these materials is described in a patent which is assigned to the same party as the above recited U.S. Pat. No. 3,576,987. That earlier device comprises a flexible outer container, wherein is contained one of the materials required for reaction to form the chemiluminescent material and a rigid, frangible inner container, which can be readily broken by merely flexing the outer container and thus permit the materials within each container to mix and form the chemiluminescent reaction.

It has now been found that a surprisingly attractive and striking product can be formed by utilizing the chemiluminescent effect of the materials, such as are described in the above-identified prior U.S. Patent, in the manufacture of articles of jewelry, or other ornamental devices for wearing on the person. In accordance with one aspect of this invention, there is provided an article of jewelry which comprises a substantially tubular member in the form of a closed loop. A chamber within the tubular member contains a chemiluminescent material and at least a portion of a wall of the tubular member is formed of a light-transmitting material. The light-transmitting material is at least translucent, and preferably, has a transmittance of at least about 50 percent. Preferably, the material is substantially transparent, i.e., having a light transmittance of preferably at least about 95 percent. In one preferred embodiment, the tubular member is formed of a substantially flexible material, and is shaped so as to fit around, and thus be supported by, a portion of a wearer's body, for example, in the form of a necklace around the neck of a wearer, a bracelet around the wrist of a wearer, or even as a ring around the finger of a wearer. The tubular member can be in the form of a closed loop, designed so as to completely encircle the intended body portion, about which it is to be worn, without falling therefrom during wearing. Alternatively, the tubular member can be in the form of an unclosed loop, e.g., in the form of a "C," preferably having a certain amount of elasticity so as to enable the device to be opened around the body portion and then to grasp the body portion, so as to prevent the device from falling off.

In another preferred embodiment, the tubular member is provided with an operating clasp means, which permits opening and closing of the loop, in order to facilitate placement of the jewelry article about the body of the wearer.

The cross-sectional shape of the tubular member is not significant in accordance with this invention. The cross-sectional shape can be circular, oval, polygonal, such as a triangle, rectangle, or hexagon. The chamber within the tube can be completely open, or a solid central core can be provided, thus forming an annular chamber. The advantage of an annular chamber is that a tube having a greater external diameter can be utilized without any increase in total volume of chemiluminescent material utilized or in thickness of the outer wall. The luminescent liquid-containing chamber can extend completely along the entire loop, or only a portion, or multiple segments, of the tube can be hollow and contain the chemiluminescent material. The chamber can be concentric, or coaxial, with the outer surface of the tube, or can be off-center, e.g., displaced away from the body of the wearer.

Preferably, the chmiluminescent material is a liquid which is capable of providing chemiluminescent light for a finite period. The precise chemical nature of the chemiluminescent composition is not critical to the definition and scope of this invention; however, the light which is emitted by the material should be in the visible range, and the material itself must be compatible with, and not adversely chemically affected by the material forming the tubular enclosure. The chemiluminescent material is generally a chemiluminescent compound which is formed by the reaction of two materials dissolved in a solvent liquid. Such material is disclosed, for example, in U.S. Pat. No. 3,597,362, and any of the materials disclosed and described in that patent, or in U.S. Pat. No. 3,576,987, by the same assignee, could be utilized. Other chemiluminescent materials, preferably liquids, can also be utilized in the present invention in order to provide the desired chemiluminescence. The chemiluminescence is obtained without the generation of heat, and thus, can be safely worn as jewelry within the enclosed tube, without injury to the person.

In a preferred aspect of the present invention, there is provided an article of jewelry having wearing means for attaching same to the body of a wearer, an ornamental portion and at least two adjacent serially connected and fully enclosed compartments, each compartment containing a chemiluminescent component, which when admixed together produce a chemiluminescent mixture. Between the two compartments there is provided releasable sealing means, which upon releasing permits the mixing of the components to produce chemiluminescence, in a connected single compartment. The connected single compartment is at least partially within the ornamental portion and the ornamental portion comprises at least a portion of a wall surface formed of a light-transmitting material, as defined above, so as to permit transmittance of the chemiluminescence from within the single chamber.

A preferred embodiment of this aspect of the invention comprises a flexible-walled tube wherein the releasable sealing means comprises opposing wall surfaces of the tube in sealing contact, e.g., pressed together so as to prevent the passage of the chemiluminescent components across the pressed-together wall portions. The wall portions can be merely mechanically pressed together, for example, by the placement of a clamp externally of the tube, pressing against the walls at the desired location. Alternatively, a most preferred embodiment comprises a pressed seal formed by folding the tube walls, at the flexible portions, such that the walls of the tube press together at the fold to form the desired releasable seal. It has been found, that depending upon the relative internal and external diameters, and the wall thickness of the tube, the angle required to bend the tube is readily obtained to form a substantially fluid-tight releasable seal. Preferably, the flexible tube is held in the folded condition by, for example, tying means which merely prevent the flexible tube from spreading out and opening the folds. Optimally, a double seal is formed, wherein a vacant space is provided between the two seals as a means of insuring that one chemiluminescent component does not pass through the sealed portion and admix with the second chemiluminescent component. The fold in the flexible tube can be formed by bending the tube in a direction transverse to the axis of the tube, such that the tube axis forms an angle at the bend. Alternatively, the tube can be folded, or twisted, about its axis, and in that manner, press the walls of the tube together. It is not necessary that the entire article of jewelry, including the tube, be formed of a flexible material. Only the folded portions need be flexible, and other, adjacent, portions can be formed of rigid or semi-rigid material. Similarly, the light-transmitting portion of the tube must only be present at that portion in which the chemiluminescent material will be present after the separating seal has been removed. The chemiluminescent components can be individually stored in substantially non-light-transmitting walled chambers and an intermediate chamber can be formed into which both components are added and from which the chemiluminescent light is generated, if desired.

In a further embodiment of this aspect of the invention, the pressed-together wall portion can be adherently sealed together, as by heat-sealing or chemical bonding, e.g., an adhesive. The adherent seal, which for the present purposes includes both cohesion and adhesion, must be releasably adherently sealed together, so as to permit opening of the seal without the tearing of the wall of the tube, so as to permit admixture of the chemiluminescent components within the tube chamber, but to prevent escape of the chemiluminescent material to outside of the tube chamber. Preferably, such a seal is formed by a heat-seal means, wherein the heat-seal is formed only at the inner surface of the walls of the tube, such that the remaining portion of the walls can be separated from the seal without tearing of the exterior surface of the tube. It has been found that a most successful releasable seal is formed when the pressed-together wall portions are undulating, as by stippling, dimpling or rippling, as by utilizing a knurled heating platen during a heat-sealing operation.

In yet another embodiment of this aspect of the invention, the two compartments can be separated by a frangible internal wall separation means, in sealing contact with the internal longitudinal walls of the tube and extending transversely therebetween and to the tube axis. The frangible wall means can be formed of, for example, a bead of a rigid, crushable material, completely different from the material forming the flexible wall of the tube, wedged between or adherently sealed to the inner wall surfaces of the tubular compartment. For example, the frangible bead can be formed of glass. Alternatively, the frangible wall means comprises a membrane transversely extending between and sealably connected to the interior surfaces of the walls of the tube. The membrane can be formed, for example, of the same polymer as the tubular wall, but for example having a substantially thinner cross section. Such a membrane can be broken by pressing the tube at a point adjacent to the membrane, so as to exert hydraulic pressure against the membrane through the chemiluminescent liquid material contained within the tube and thus burst the membrane. The membrane can also be formed of a different material than the tube wall and can be connected thereto either by heat-sealing, if the materials are mutually adhesive, or by the utilization of an intermediate adhesive.

In yet another aspect of the present invention, there is provided means for replaceably providing a chemiluminescent material within a light-transmitting portion of the article of jewelry. In accordance with this aspect of the invention, there is provided an article of jewelry having an ornamental member connected to a wearing means, for attaching the jewelry to the person, which is also connected to wall means defining a chamber for chemiluminescent material. At least a portion of the wall means is formed of a light-transmitting material and is disposed so as to transmit light to illuminate the ornamental member. Replacement means are provided for replaceably adding a chemiluminescent material operatively adjacent the ornamental portions. Preferably, the light-transmitting wall means defines at least a portion of the ornamental configuration such that chemiluminescent light generated in the chamber is conducted to and through the light-transmitting material, to be visible directly through the ornamental configuration when the article is worn. Alternatively, the chemiluminescent light can be indirectly visible by being reflected from a light-reflecting surface of the ornamental member. In this embodiment, the light-transmitting wall is disposed so as to direct at least a portion of the light towards the ornamental member which then reflects the light outwardly towards an observer.

The replacement means includes means for replaceably inserting a cartridge containing the chemiluminescent material, as well as means for replaceably adding and disposing of chemiluminescent material directly into a chamber formed adjacent the ornamental portion of the article of jewelry. In a first embodiment of this aspect of the invention, the replacement means on the article of jewelry comprises retaining means connected to the ornamental portion and adapted to replaceably retain a cartridge chamber operatively adjacent the light-transmitting ornamental portion. A replaceable cartridge is replaceably retained by the holding means. The cartridge comprises at least a light-transmitting wall portion, which is retained operatively adjacent the light-transmitting or light-reflecting surfaces of the ornamental member, so as to transmit the chemiluminescence from within the cartridge to the ornamental portion. The retaining means can comprise a slot adapted to removably receive and retain at least a portion of the cartridge, or other mating means for retaining the cartridge in operative contact with the ornamental portion. In this aspect of the invention, the entire article of jewelry can be rigid, including the ornamental portion. The cartridge can be either rigid or flexible, depending upon the configuration thereof. The cartridge can include, for example, a flexible tube of the type described above, which contains a chemiluminescent liquid.

In a second embodiment of this aspect of the invention, the replacement means comprises a chamber operatively connected to the ornamental portion of the article of jewelry. The chamber comprises flow means for introducing and removing chemiluminescent material, prefeably chemiluminescent liquid, into and from the chamber. For example, the flow means can comprise manually removable cap means or openable valve means, at at least one, but preferably two, portions of the chamber. Preferably, however, the flow means comprise at least one automatically sealed valve means, operable in response to a matching valve opening member. The valve opening member is preferably connected to, for example, a reservoir for a chemiluminescent material, or to an evacuation means for removing spent chemiluminescent material from the chamber. The valve means in the chamber is automatically sealed, unless connected to the mating portion on the reservoir and/or removal means. Such valves and mating portions are well known to the art, and provide no part of this invention.

In a most preferred embodiment of this aspect of the invention, individual reservoirs are provided for two or more chemiluminescent components required to form the chemiluminescent material. This permits a substantially indefinite storage of the chemiluminescent components until it is desired to wear the jewelry, at which time the chemiluminescent components can be mixed within the chamber and the chemiluminescence generated. The components can be mixed before injection into the chamber. However, at least two separate materials can be individually metered into the chamber in the desired proportions. This can be readily accomplished by providing pump means with each reservoir, of known configuration, for injecting a measured amount of each component into the chamber. Such metering pumps are also well known to the art, and again, form no part of the present invention.

The utilization of a replaceable cartridge or a refillable chamber permits the formation of a rigid light-transmitting ornamental portion. Thus, even a precious stone can be utilized, and thus enhanced by the chemiluminescent effect provided by the present invention. The chemiluminescence which is generated in accordance with the present invention can be directly seen as refracted light through a light-transmitting material, or indirectly by way of reflected light from a light-reflecting material, and/or a light-transmitting material. Of course, the chamber, or cartridge, which immediately contains the chemiluminescent material must itself comprise at least a wall portion formed of a light-transmitting substance.

The color of the light can be varied by either utilizing a chemiluminescent material which itself generates light at the desired color, or alternatively, if this is not readily obtainable, by utilizing a colored light-transmitting material. The light-transmitting material can be any type of a translucent or transparent synthetic polymer, for example, a polyolefin material, such as polyethylene, especially medium density or high density polyethylene, polypropylene; polycarbonate; the vinyl polymers, such as polyvinylchloride polymer; the acrylics, such as methylmethacrylate polymer; or copolymers, terpolymers, or multipolymers thereof; allyl resins; cellulosic materials, such as cellulose acetate, cellulose propionate, or ethyl cellulose; cast epoxy resin, including phenol novolac resins, o-cresol novolac epoxy resins; fluoroplastics, such as polychlorotrifluoroethylene, as well as PFA and FEP fluoroplastics, Teflon; transparent clear nylon; thermoplastic polyesters; polystyrenes; cast polyurethanes; and other vinyl polymers, such as chlorinated polyvinyl chloride compound, propylene-vinylchloride copolymer, and vinyl chloride-acetate polymers. It is well known to the art, which of the above polymers are obtainable in flexible and/or rigid forms. As indicated above, the material forming the chambers and/or cartridges and/or tubes, must be inert to, i.e., must not affect, the chemiluminescent material contained therein. Thus, the use of plasticizers, or other additives in such polymers must be carefully considered in the context of the present invention.

The chemiluminescent materials, which are available at the present time, are generally reacted in the liquid state to generate chemiluminescence. These materials, which are described in the previously-referred to U.S. Pat. Nos. 3,576,987 and 3,597,362, include those materials which are per se solids, but which are dissolved in a liquid solvent. In those aspects of this invention, wherein the article is divided into two or more chambers, each containing a chemiluminescent component, which must be admixed with another component to generate chemiluminescence, the various components can be divided in different ways. For example, when the reactive chemiluminescent compounds are all solids, but will react only in the dissolved state, all of the reactive solid can be maintained in a single compartment, and the second compartment can contain only the inert solvent. Alternativey, the components can be maintained in solution, but divided into separate compartments, so that before the chemiluminescent reaction can occur, the solutions must be admixed. As pointed out in the previously-referred to U.S. Patents, the major active components include a chemiluminescent compound and a hydroperoxide compound, which reacts with the chemiluminescent compound to generate chemiluminescence. In addition, there must also be present a fluorescent material, which will fluoresce in the visible light range when subjected to the energy generated by the reacting chemiluminescent compound. The examples given in the above-referred to patents are generally esters of oxalic acid and either hydrogen peroxide or an organic peroxide. Various fluorescent dye materials are listed as suitable fluorescing compounds. In the context of a two-compartmented article, the hydroperoxide and the chemiluminescent compound must at all times be separated, until the desired chemiluminescent reaction is initiated. The fluorescing agent is also preferably maintained together with the chemiluminescent compound, because of the highly reactive nature of the peroxide. The various other additives, which are indicated as being useful in a chemiluminescent material, include a catalyst, an accelerator, a decelerator, and specifically, either an organic quaternary cation-containing compound, or an alkali metal salt.

A greater understanding of the present invention, which, however, should not limit the full scope thereof, can be seen by reference to the drawings. The drawings are intended to merely exemplify certain preferred embodiments of the various aspects of this invention, described above, without limiting their scope:

Figure 1:
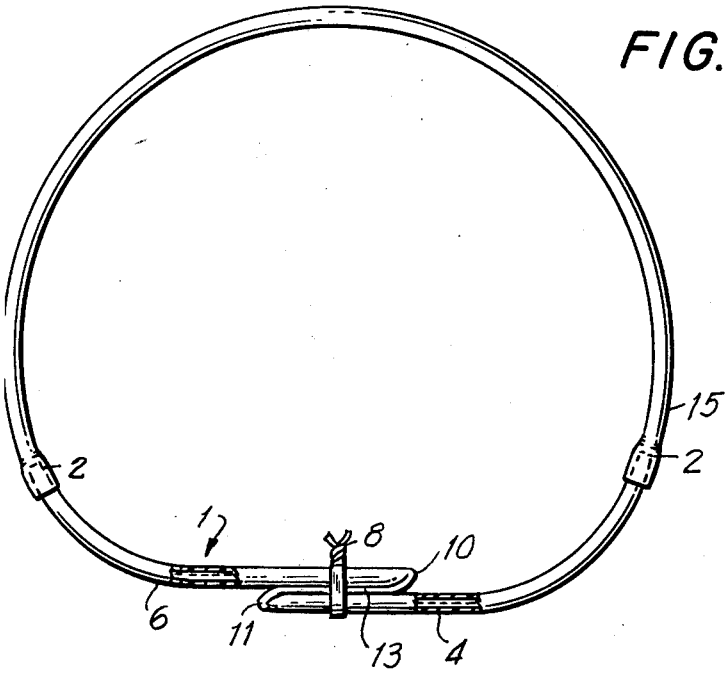
FIG. 1 shows one embodiment of a closed-loop, multi-compartmented article of jewelry.

FIG. 1 depicts an article of jewelry, specifically a necklace, comprising a flexible tube 1, sealed at both ends 2, and in the condition shown in the drawing, comprising two serially connected compartments 4 and 6, each containing a different chemiluminescent component. The tube is shown in a folded condition, folded in a zig-zag pattern, generally resembling the letter Z. The Z-fold is held together by a tie tack 8. The walls of the flexible tube 1, at each of the apices 10 and 11, are pressed together, so as to prevent the passage of the liquid chemiluminescent components from each of chambers 4 and 6. The intermediate chamber 13, formed between the two apices 10 and 11, is substantially empty of a liquid. When the tie tack 8 is removed, and the fold is released, such that the tube 1 is in a linear condition, forming a single compartment in which the chemiluminescent components in chambers 4 and 6 are admixed, chemiluminescence is generated, and the resultant loop is of a size suitable for use as a necklace for an adult. The chemiluminescent material formed in the single compartment is of the type described in U.S. Pat. No. 3,576,987.

Figure 2:
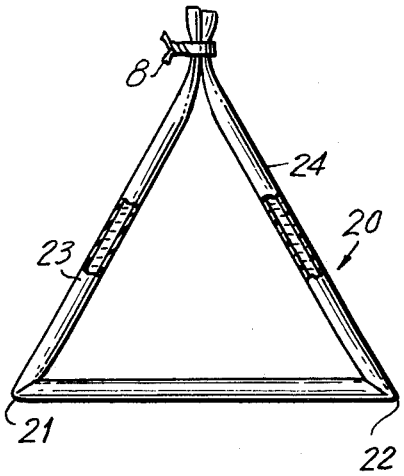
FIG. 2 is a second embodiment of a multi-compartmented flexible tube.

Referring to FIG. 2, the section of a flexible tube shown herein, shows a fold of a different shape, generally forming a triangle. The angles of the folds, at corners 21 and 22 of the tube 20, result in the walls of the tube being sufficiently pressed together as to prevent the passage of fluid therethrough. As depicted in FIG. 2, compartments 23 and 24 contain chemiluminescent components, which when admixed together provide and generate chemiluminescence. The center compartment between apices 21 and 22 is substantially empty of any liquid.

Referring to both FIGS. 1 and 2, it is not necessary that the chambers containing the chemiluminescent components, chambers 4 and 6 and chambers 23 and 24, have flexible walls. It is only necessary that the walls of the tubes 1 and 20 at the folds be flexible, and the remaining portion of the tube can, if desired and useful, be formed of a rigid or semi-rigid material.

Figure 3:
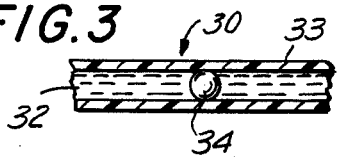
FIG. 3 is a cross-sectional view of yet another embodiment of a multi-compartmented flexible tube device.

FIG. 3 shows yet another method of forming a multi-compartmented article in a single flexible tube. The tube 30 is divided into two sections, 33 and 32, by a frangible glass bead 34. The bead is wedged tightly within the tube 30 and presses against the walls of the tube 30 sufficiently to prevent the passage of any fluid, liquids, thereacross. If desired, a second frangible bead can be placed at a point distant from bead 34, so as to form an intermediate insulating compartment, as is shown in FIGS. 1 and 2, formed between the two beads. This results again in an improved separation of the chemiluminescent components, so as to prevent any desirable, accidental admixture thereof, prior to the desired time of use. As the chemiluminescent material, once chemiluminescence begins, has only a finite life, it is, of course, desirable to maintain the components completely separated in order to attain a desirably long storage time.

Figure 4:
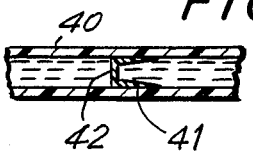
FIG. 4 is a cross-sectional view of another embodiment of a multi-compartmented flexible tube device.

FIG. 4 shows another method of separating a flexible tube into several compartments. In this case, a frangible membrane 42 stretches transversely between the flexible walls of tube 40. The membrane 42 can be burst by increasing the pressure adjacent thereto, as by squeezing the walls of the tube 40 together at or on one side of the membrane 42. Although two membranes can be utilized to form again an insulating space therebetween, such space is less needed in the present situation, because of the complete seal which is obtainable by the use of this method. There is little likelihood of any leakage past a seal of this type, as long as the membrane is intact. Such a membrane can be formed, for example, by inserting into the open tube 40 a cup-shaped member formed of a thinner and/or weaker or more brittle material than the walls of the tube 40. The external diameter of the cup should be substantially equal to, or just slightly larger than, the internal diameter of the tube 40, and can be pushed a desired length into the tube 40, at which time, the side walls of the cup, residues of which are shown in FIG. 4 as numeral 41, are then sealed, either by an adhesive or by a heat-sealing method to the walls of the tube 40. The membrane 42, which can be a relatively brittle thermoset resin, such as bakelite, or even glass, or of a relatively weak thermoplastic material, including the same polymer, but in thinner cross-section than the tube walls 40, or as another preferred alternative, a mutually adherent material, sealed to the walls of the tube, thus forming a completely fluid-tight seal.

Figure 5:
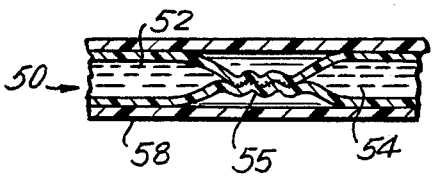
FIG. 5 is a cross-sectional view of yet another multi-compartmented flexible tube device.

An adherent seal is shown in FIG. 5, dividing the flexible tube 50 into two compartments 52 and 54. The adherent nature of the seal, indicated at point 55, can be obtained, for example, by the use of a releasable heat-seal of the walls of the tube 50. The walls of the tube are pressed together, for example, between heated platens, which cause a fusing of the internal surfaces of the wall, which fused seal can be reopened by merely pressing on the tube in a direction transverse to the direction of pressure exerted by the platens, i.e., in a direction transverse to the surface of the drawings. As shown, the surfaces of the tube are dimpled or knurled, which is obtained by utilizing a knurled heated platen.

A second seal of this type can be provided, so as to form an intermediate insulating compartment between the two seals, as shown, for example, in FIGS. 1 and 2.

In order to insure against any leakage that may occur when the heat-seal 55 is released, as by pressing transversely thereof, a second outer tube 58 is placed about the tube 50 at least in the area of the heat-seal 55. The inner tube 50 can, either be slip-fitted into the outer tube 58, or an adherent seal, either utilizing a chemical adhesive or a heat-seal, between the outer surface of the walls of tube 50, and the inner surface of the walls of tube 58, can be utilized to further prevent any leakage of fluid which may pass from the inner tube into the space between the inner tube and the outer tube at the depressed heat-seal area. This outer tube is not always necessary, and the use of sufficiently thick-walled inner tube and a careful heat-seal on the inner surfaces without weakening the wall therethrough, can prevent any leakage upon releasing of the heat-seal. Such a heat-seal can be formed, for example, utilizing an induction heating method, wherein only the inner walls of the tube are fused together, without weakening or fusing the remaining portion of the wall thickness.

Figure 7:
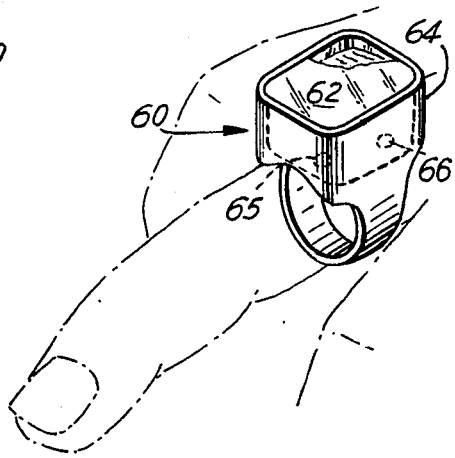
FIG. 7 is an article of jewelry, including a refillable chamber.

Referring to FIG. 7, a ring is utilized as the example for an article of jewelry, having a refillable chemiluminescent chamber. The ring, generally indicated by the numeral 60, having formed therein and thereunder a hollow chamber defined by the ornamental portion 62 and the sides of the ring 64. At the base portion of the chamber defined by walls 62 and 64 are placed two halves 65 and 66. The two valves are specially adapted female members, adapted to mate with male members, connected to a reservoir for a chemiluminescent component. The valves 65 and 66 are maintained in a sealed condition, until the mating male member is inserted therein, and a valve opened. Such devices are commonly available commercially. In the embodiment shown, one valve is to be utilized for the injection of one of two chemiluminescent components, and the other valve is to be used for the injection of the second chemiluminescent component, thus avoiding contamination of the reservoir by any liquid that may be adhered to the valve from a previous refill. The chemiluminescent components can be injected into the refillable chamber under pressure, and/or a relief mechanism can be provided in the upper portion of the chamber defined by walls 64 and 62, to provide for escape of air displaced by the entering liquid. The spent chemiluminescent material, after the finite duration of its chemiluminescent reaction, can be removed by a pump inserted into either of the valves shown, and the spent liquid pumped out. As shown, only the wall surface 62 is light-transmitting, and can be either colorless, or in any desired color stone. The material is, of course, rigid as shown, as are the side walls 64, and can be formed of any desired materials, including even a precious or semi-precious transparent or translucent stone. The interior surfaces of wall 64 can be highly polished to act as reflector surfaces, to increase the brilliance of the light passing out through the light-transmitting surface 62. In a most preferred embodiment of this aspect of the invention, depicted by FIG. 7, the devices for injecting the chemiluminescent components into the chamber of ring 60, include metering means for injecting a suitable amount of chemiluminescent components to react with a measured amount of the second component. The injection means can include, for example, a squeeze pump, which on one portion of its cycle, exhausts air from within the chamber of the ring 60, and on the second stroke of its cycle, injects an equal amount of the liquid. This would remove the requirement for a high-pressure injection system and/or of a relief valve system. If desired, a third valve could be utilized for removing spent chemiluminescent liquid from the chamber of ring 60, and thus avoid contamination of either of the injection valves 65 and 66. The material can be removed by a pump, which on one stroke again injects air into the ring, and on the second stroke, removes an equal amount of liquid. Provision can be made for, for example, rinsing the chamber of ring 60 with inert solvent, after the spent chemiluminescent liquid has been removed, thus again preventing contamination of a fresh chemiluminescent liquid with a spent material.

The various embodiments shown in the above drawings should be formed of materials, which are in contact with the chemiluminescent materials, which are inert to, and do not adversely affect the reactivity of the chemiluminescent materials.

Such materials include, for example, polyolefins, such as medium or high density polyethylene; polyvinylchloride, especially rigid polyvinylchloride; mineral materials, such as quartz, glass or precious or semi-precious, translucent or transparent stones; metal or other opaque materials for those portions of the chemiluminescent chambers, which are not required to be light-transmitting. Those opaque portions of the chambers are preferably light-reflecting, so as to increase the intensity of light passing through the light-transmitting, visible portions of the chambers.

Figure 6:
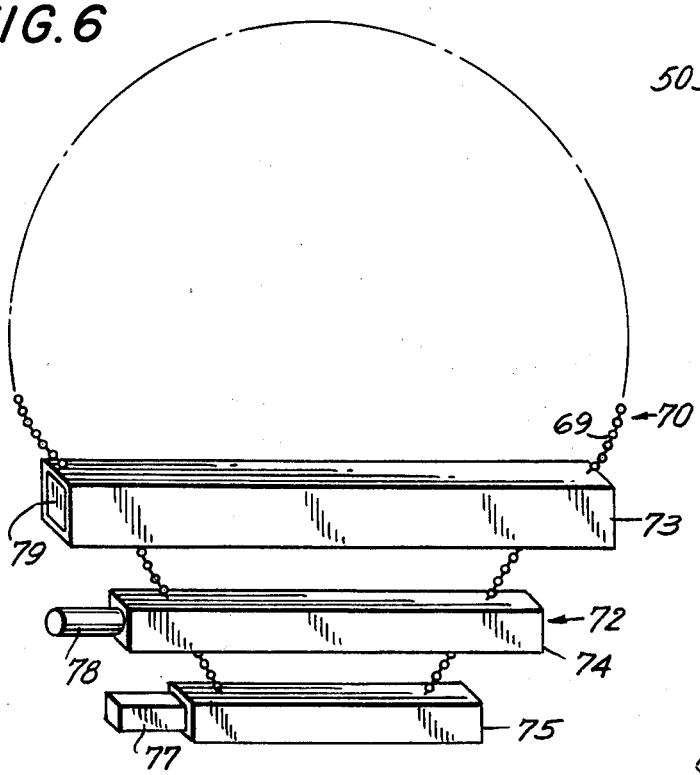
FIG. 6 is a rendering of an article of jewelry, having replaceable chemiluminescent cartridge means.

Referring now to FIG. 6, the embodiment depicted here shows the use of a replaceable cartridge in an article of jewelry. The replaceable cartridge contains a chemiluminescent material and can be inserted into the rigid, (or flexible, if desired) ornamental portions of the article of jewelry. As shown, a necklace, generally indicated by the numeral 70, includes a neck piece 69, of a sufficient length to fit around the neck of an adult wearer, and formed, for example, of a gold chain. The ornamental portion, generally indicated by the numeral 72, comprises a series of polyhedrons, formed of a rigid, light-transmitting material, in this case, a quartz glass. A channel is formed within each of the quartz polyhedrons 73, 74 and 75, into which is inserted a replaceable cartridge 77. The cartridge can be either flexible or rigid, but should be a relatively snug fit within the chamber within each of the polyhedrons 73, 74 and 75. The cartridge within each polyhedron should preferably extend substantially the entire length of the polyhedron. Further, preferably, the cartridge is a storable-type cartridge, and thus, has at least slightly flexible, or elastic walls, suitable for forming a compartmentalized tube, as shown, for example, in FIGS. 1 through 5. Thus, each cartridge can be stored for a substantial period of time, and activated by joining the compartments as explained above. This permits the utilization of a relatively expensive and complex article of jewelry, to which a chemiluminescent feature can be added, when desired.

The embodiments set forth in the above drawings, and elsewhere verbally described in this specification, are merely exemplary of the full scope of the present invention. The scope of the invention is intended to include the use of materials, and concepts, which fall therewithin, which are not only now available, but which will become available in the future. Various changes and modifications of the invention may be made as new technologies develop, or as old technologies are applied thereto, without departing from the spirit of the disclosure, or the scope of the following claims, which are intended to define the scope of this invention.

The "wearing means" for attaching the jewelry to the body of the wearer includes not only jewelry worn directly on the body, such as a necklace, bracelet, anklet, tiara or earring, but also worn on clothing, such as a brooch, or pin.

The ornamental member can comprise a flat smooth surface, a multi-faceted surface, a curved surface of any other configuration, design or representation. Similarly, it can be made of a light-transmitting material or opaque and preferably light-reflecting material, or any combination thereof.

The folds or bends in the multi-compartmented tube of this invention can all be in substantially the same or parallel planes, or if desired, they can be in different, transversely aligned planes.

What is claimed is:

1. An article of jewelry adapted to be worn on the body of a person comprising wearing means for attaching the jewelry to the body of a wearer; a flexible walled tube formed of a light-transmitting material, sealed at both ends of the tube and being folded at two intermediate locations in such a manner that the opposing interior surfaces of the flexible tube walls are in sealing contact at these two locations, thereby defining a sealed intermediate chamber therebetween and at least two additional end chambers between each fold portion and its nearest sealed end; and a chemiluminescent component contained in each of the two end chambers, the intermediate chamber being substantially free of a chemiluminescent component, whereby unfolding the tube, so as to permit the interior walls to move out of sealing contact permits the mixing of the components to produce chemiluminescence in a connected, single compartment.

2. The article of claim 1 comprising in addition tieing means for maintaining the tube in the folded condition.

3. The article of claim 2, wherein the two folds are in opposing directions to form a Z-configuration.

* * * * *